United States Patent [19]

Reynolds et al.

[11] 4,150,791

[45] * Apr. 24, 1979

[54] RAIL FASTENER

[76] Inventors: Clarke Reynolds, 535 Hillary Dr., Tiburon, Calif. 94920; Richard J. Quigley, 25538 Adobe La., Los Altos Hills, Calif. 94022

[ * ] Notice: The portion of the term of this patent subsequent to Sep. 13, 1994, has been disclaimed.

[21] Appl. No.: 764,306

[22] Filed: Jan. 31, 1977

[51] Int. Cl.[2] ..... E01B 9/48

[52] U.S. Cl. ..... 238/282; 238/283; 238/310; 238/349

[58] Field of Search ..... 238/264, 282, 283, 287, 238/304, 310, 349–351, 107, 297, 295, 275, 309, 307, 303

[56] References Cited

U.S. PATENT DOCUMENTS

| | | | |
|---|---|---|---|
| 1,926,088 | 9/1933 | Faries et al. | 238/304 |
| 1,942,464 | 1/1934 | Willard | 238/287 |
| 2,127,430 | 8/1938 | Scholes | 238/304 |
| 2,954,169 | 9/1960 | Rigby | 238/351 |
| 3,451,621 | 6/1969 | Splinter | 238/283 |
| 3,476,317 | 11/1969 | Gassner | 238/283 |
| 3,724,754 | 4/1973 | Molyneux et al. | 238/349 |

FOREIGN PATENT DOCUMENTS

| | | | |
|---|---|---|---|
| 213437 | 7/1960 | Austria | 238/283 |
| 450986 | 9/1948 | Canada | 238/287 |
| 2347794 | 10/1975 | Fed. Rep. of Germany | 238/287 |
| 98881 | 8/1961 | Netherlands | 238/349 |
| 385262 | 3/1965 | Switzerland | 238/310 |

OTHER PUBLICATIONS

Landis/Pandrol Sales Literature, dated Mar. 1977.

*Primary Examiner*—Francis S. Husar
*Assistant Examiner*—Ross Weaver
*Attorney, Agent, or Firm*—Lowhurst & Aine

[57] ABSTRACT

A rail fastener includes a rail plate, a pad of elastomeric material between the plate and a support structure, and a pair of posts for laterally and longitudinally restraining the rail plate with an insulator bushing mounted between the posts and cooperating peripheral surfaces of the openings in the rail plate. Each of these posts is preferably formed of two parts, one of which is embedded in the support structure, and the other of which is an eccentric which is releaseably attached thereto. Rotation of the eccentrics provides lateral and longitudinal adjustment of the rail plate with respect to the support structures, thereby providing lateral adjustment of the rail with respect to the support structure.

4 Claims, 3 Drawing Figures

RAIL FASTENER

BACKGROUND OF THE INVENTION

1. Field of the Invention

This invention relates generally to a rail fastener and more particularly to a fastener for holding a rail onto a support structure which provides improved electrical isolation and vibration and sound attenuation between the rail and the support structure and permits improved lateral adjustment of the rail with respect to the support structure, while maintaining structural integrity between the rail and the support structure.

2. Prior Art

Direct fixation rail fasteners have been employed extensively in recent years in place of tie-on ballast arrangements for affixing transit rail apparatus to a rigid support structure. Because of the stress conditions placed on the rail and supporting structure by the transit apparatus, as well as by changing enviromental conditions, such as temperature, moisture, etc., direct fixation of a rail to a concrete support structure is not a simple matter. Structural integrity must be maintained between the rail and the support structure, but vibrations, including sound vibrations, which are generated in the rail must be attenuated before reaching the support structure. Direct fixation design is still further complicated by the fact that many of the transit systems are electrically energized and use the rail as the return path for the energizing electrical current, and as a result, the rails must be electrically isolated from the support structure. Also, such fasteners must be capable of permitting lateral adjustment or positioning of the rail with respect to the support structure. The most severe compromise, however, is that which must be achieved between attaining a desired amount of structural integrity between the rail and the support structure while sufficiently attenuating any vibrations which may be transmitted from the rail to the support structure.

As a rail mounted vehicle moved along a track, a differential wave is caused to build up in the rail in front of the vehicle because of the leverage action which results from the localized vertical forces applied to the rail by the wheels of the vehicle. Thus, a given portion of the rail is subjected to first an upward force as the vehicle approaches and then a downward force as the wheels roll thereover. Where the rail is directly affixed to the support structure, this wavelike motion will produce a pounding action between the rail and the supporting concrete structure which will tend to disintegrate the concrete unless some means is provided between the rail and the concrete structure to absorb the impact therebetween.

In addition to the deleterious effects on the concrete structure produced by the pounding action, undesirable sonic vibrations will be introduced to the surrounding structures. Thus, suitable means must be incorporated into the rail fastener device to absorb shock and dissipate some of the energy in order to attenuate the noise which would otherwise be transmitted into surrounding buildings and other structures.

Another problem which must be overcome in attaching a rail directly to a concrete support structure is that of maintaining gage accuracy between the rails. This is especially true in areas where the supporting structures will be subjected to sinking, earthquakes, and other uncontrollable phenomenon. Thus, means must be provided in direct fixation rail fasteners which will permit the rails to be adjusted laterally within reasonably limits. As an example, one current set of design specifications require that lateral adjustments be at least plus or minus one-eight inch.

In addition to providing vibration attenuation and rail position capability, a rail fastener must also provide structural integrity between the rail and the support structure. However, a compromise exists between structural integrity and vibration attenuation, since structural integrity implies a relatively rigid fixation device between the rail and the support structure, while vibration attenuation implies a non-rigid fixation device. That is, a rail fastener must be sufficiently rigid to provide structural integrity between the rail on the support structure, but must be sufficiently non-rigid to be able to attenuate vibrations transmitted from the rail to the support structure. This problem is further compounded by the requirement that the fastener must be capable of permitting lateral adjustment or positioning of the rail with respect to the support structure. Such lateral positioning capability is incompatible with the requirements for structural integrity.

When a vehicle moves over a rail, in addition to the differential pressure wave discussed above, the rail will be subjected to overturning moments and shear forces, particularly in a curved portion of the track. If a rail is permitted to move laterally when lateral shear forces are imposed thereon, the gage of the track will not be maintained and the vehicle may lose contact with the rail. However, all of the known direct fixation rail fasteners which are capable of absorbing the above mentioned vertical forces do not achieve a proper balance between lateral restraint of the rail and vibration attenuation. That is, those prior known direct fixation rail fasteners which provide a sufficient amount of structural integrity between the rail and the support structure are not capable of sufficiently attenuating vibrations transmitted from the rail to the support structure. On the other hand, those direct fixation rail fasteners which are capable of sufficiently attenuating vibrations are not capable of providing a sufficient amount of lateral restraint and, therefore, structural integrity between the rail and the support structure.

In addition to the above mentioned problems encountered in the direct fixation of a rail to a support structure, prior known direct fixation rail fasteners have other disadvantages. Presently, the most widely used type of rail fastener employs a shear pad in which a layer of elastomeric material is sandwiched between two plates, with the rail being clamped to the top plate and the bottom plate being clamped to the support structure. These shear pads type of rail fasteners include structures for laterally restraining the top plate with respect to the bottom plate. Also, the majority of these rail fasteners are capable of positioning the rail laterally with respect to the support structure, but are not capable of adjusting the lateral position of the rail with respect to the support structure. Examples of such rail fasteners are disclosed in U.S. Pat. Nos. 3,576,293; 3,784,097; and 3,858,804.

The rail fasteners disclosed in these patents include a shear pad which is formed of a pair of metallic plates having a layer of elastomeric material sandwiched therebetween. The shear pad is secured to the support structure by a pair of studs and additional means are provided for laterally positioning the rail with respect to the shear pad and support structure. The lateral positioning structures disclosed in those patents include serrated members which are relatively difficult and costly to manufacture. Furthermore, this type of lateral positioning structure cannot be manipulated to laterally adjust the rail to a desired location on the shear pad. That is, these lateral positioning structures are not capable of moving the rail with respect to the shear pad and, therefore, the rail must be moved by additional means while the lateral positioning structures are being relocated. Accordingly, it can be appreciated that the lateral positioning means disclosed in the above-mentioned patents do not, in fact, adjust the lateral position of a rail, but hold the rail in a desired location after it has been positioned laterally with respect to the shear pad.

One of the problems encountered in the shear pad type of rail fasteners is that of providing a sufficient amount of vibrational dampening while maintaining a desired amount of lateral restraint. The device disclosed in U.S. Pat. No. 3,576,293, laterally restraints the elastomeric layer by providing the bottom plate of the shear pad with an upturned flange for holding the lateral edges of the elastomeric layer. It was found, however, that with the incorporation of voids in the elastomeric layer to increase the vibrational dampening effect thereof, such a upturned flange did not provide the desired amount of lateral restraint to the elastomeric layer. Furthermore, lateral shear forces imposed on this upturned flange would eventually result in fracture thereof, thereby further decreasing the lateral restraint of the fastener. This problem was solved, as disclosed in U.S. Pat. No. 3,784,097, by the use of a nylon insert mounted between each anchor bolt and an edge of the upper plate of the shear pad. Any attempted lateral movement of the upper plate of the shear pad would bear against the nylon insert and impose a shear force on the anchor bolt or the sleeve surrounding it. It has been found, however, that this arrangement is unsatisfactory for a number of reasons.

Whenever attempted lateral movement of a rail imposes shear forces on a bolt or other anchor structure, such shear forces will eventually fatigue and anchoring fastener, untimately resulting in failure thereof. In addition, such an arrangement does not provide a sufficient amount of vibration and sound attenuation between the rail and the support structure. Such a nylon insert, or any other noncompliant insert, transmits noise and other vibrations with relatively little attenuation. As previously mentioned, one of the requirements of such rail fasteners is to attenuate such noise to an acceptable level so that such noise will not be transmitted into the surrounding ground and to adjacent building.

Furthermore, the anchoring bolts of a fastener usually place the concrete which is in immediate contact therewith in tension when they are tightened to hold the fastener onto the concrete support structure. That is, these anchoring bolts are pulling the fastener and the concrete support structure together, thereby placing a portion of the concrete structure in tension. Any vibrations transmitted through the anchoring bolts to the concrete add transient forces to the pretensioned concrete. Such tensioning of the concrete around the anchoring bolts or the inserts to which they are threaded contributes to its ultimate fatigue. Pulverization of the concrete support structure in which the anchoring bolts are attached will eventually weaken that attachment. As that attachment weakens, the anchoring bolts will have greater freedom of movement, thereby further increasing the pulverization of the concrete support structure. Such movement of the anchoring bolt will also lead to fatigue thereof, with the end result being that either the anchoring bolt will fracture or the support structure will eventually lose its grip thereon.

In an attempt to overcome this problem, prior known rail fasteners employ the technique of clamping the bottom plate of the shear pad as tightly as possible to the surface of the support structure so that relatively little or no movement will exist when extreme lateral shear loads imposed thereon. However, this clamping of the bottom plate of the shear pad to the support structure does not eliminate the transmission of vibrations therethrough. Furthermore, tightly clamping the bottom plate of the shear pad to the supporting structure further increases the tension produced in that portion of the concrete support which grips either the anchoring bolt or the insert in which it is threaded.

In a further attempt to overcome this problem and in addition to clamping the bottom plate of the shear pad to the support structure, additional means have been provided for compressing the elastomeric layer, such clamping of the elastomeric layer reduces its ability to attenuate sound and other vibrations, with the result that such vibrations will be transmitted to the anchoring fastener and the support structure.

Others have attempted to solve the problem of attenuating vibrations produced by vertically directed forces by placing a layer of elastomeric material such as rubber, directly between a rail plate and the concrete support structure. However, all of these attempts have a direct connection between the rail plate and the support structure which provides structural integrity between the rail and the support structure, but does not attenuate any vibrations which are transmitted from the rail, through the rail plate and the anchoring decives to the support structure. These devices are not, in fact, shear pads, since they do not permit even a limited amount of lateral movement of the rail plate with respect to the support structure. In the absence of such lateral movement, and because of the direct connection between the rail plate and the support structure, vibrations are not attenuated. In effect, this type of rail fastener is only capable of dampening those vibrations which are the result of vertical forces applied to the rails by the wheels of the vehicle passing thereover. All of the prior known fasteners of this type have employed an elastomeric material such as rubber which is highly abrasive. As a result, this type of rail fastener has not proven satisfactory in use over a prolonged period of time because of the ultimate destruction of the elastomeric layer. An example of such a fastener is disclosed in U.S. Pat. No. 2,146,341.

The shear pad type of rail fastener is also subject to a loss of structural integrity between the rail and the support structure due to failure of one of more parts thereof. In the shear pad type of rail fastener, it has been the practice to provide voids in that portion of the elastomeric layer which is directly beneath the rail, such that its dampening effect on vibrations will be increased. The portions of the elastomeric material, however, which extend to the edges of the rail plate are not so relieved. As a result, whenever a load is placed on the rail, the rail plate will bow, since the edges thereof are held from downward movement by the solid elastomeric material, whereas the center portion thereof which is beneath the rail is permitted to move vertically. Continuous flexure of the rail palte will eventually result in its becoming fatigued. Many of the prior known fasteners of the shear pad type provide slots or other openings in the rail plate for receiving other members therein, such as clamping bolts. The absence of material in these areas further increases the liklihood of structural failure of the rail plate under such flexural conditions.

It has also been the practice in the past to bond the elastomeric material to the surface of any elements which join the top and bottom plates of the shear pad. The elastomeric material at those areas will eventually fail under prolonged and repeated flexure of the rail plate. Such failure of the elastomeric material at those areas also reduces the structural integrity of the rail fastener.

As previously mentioned, many of the prior known rail fasteners of the shear pad type are provided with openings in the rail plate for receiving clamping elements, for example, therein. Usually these openings extend through the elastomeric layer of the bottom plate of the shear pad. These openings provide pockets for accumulating debris which may eventually form an electrical contact between the rail plate and the bottom plate of the shear pad. Since present day rail fasteners are required to provide electrical insulation between the rail and the support structure, such accumulation of debris can destroy the electrical insulation capability of a rail fastener.

SUMMARY OF THE INVENTION

It is, therefore, a primary object of the present invention to provide a rail fastener which provides a sufficient amount of structural integrity between a rail and a supporting structure and also provide a sufficient amount of attenuation to any vibrations which may be transmitted from the rail to the support structure.

A further object of the present invention is to provide such a rail fastener which employs a pad of elastomeric material which is in direct contact with the surface of the supporting structure and does not require the use of a bottom plate for maintaining structural integrity between the rail and the support structure.

Still another object of the present invention is to provide such a rail fastener in which the rail plate thereof is not subject to flexure.

A related object of the present invention is to provide such a rail fastener in which the rail plate thereof is permitted to move in its entirety in a downward vertical direction with applied loads but not in an upward vertical direction above a no-load level.

Yet another object of the present invention is to provide such a rail fastener in which the rail plate is provided with a well dimensioned to accomodate the rail and a means of fastening the rail to the plate that allows limited upward motion but no downward motion.

Another object of the invention is to provide a rail fastener having a rail plate which can move down but not up and a rail clip to allow the rail, on the plate, to move up but not down with respect to the plate.

Still a further object of the present invention is to provide a rail fastener having a lateral adjusting device which is capable of translating the rail attached thereto in a lateral direction with respect to a support structure.

A related object of the present invention is to provide such a rail fastener which can be easily and quickly adjusted in a lateral direction with respect to a support structure.

A feature of the present invention resides in the provision of an insulating bushing between edges of the rail plate and the posts, which provides electrical insolation and mechanical rigidity.

Another feature of the present invention resides in the provision of eccentrics as the lateral restraint posts, which eccentrics can be rotated to laterally position the rail plate and with respect to the supporting structure.

Still a further feature of the present invention resides in the provision of relatively large cross sectional area posts for laterally restraining the rail plate, such that a bottom plate is not needed. That is, these lateral restraining posts are of a size which will eliminate any movement thereof under any expected lateral shear forces imposed thereon in the absence of a bottom plate.

These and other objects of the present invention are attained by a rail fastener in which a rail plate is seated on an elastic pad to allow it to move downwardly under load but which is fastened by bolts with a collar which restrains the plate from rising above a no-load or small load level. Further, the rail plate is shaped with a well to accommodate the rail and restrain it against lateral displacement and a pair of clips which urge the rail firmly against the rail plate but allow the rail to move upwardly under load against the elastic force of the clips.

The invention, however, as well as other objects, features and advantages thereof will be more fully realized and understood from the following detailed description, when taken in conjunction with the accompanying drawing, wherein:

BRIEF DESCRIPTION OF THE DRAWING

Like reference numerals throughout the various views of the drawing are intended to designate the same elements.

DETAILED DESCRIPTION OF THE PREFERRED EMBODIMENT

Figure 1:
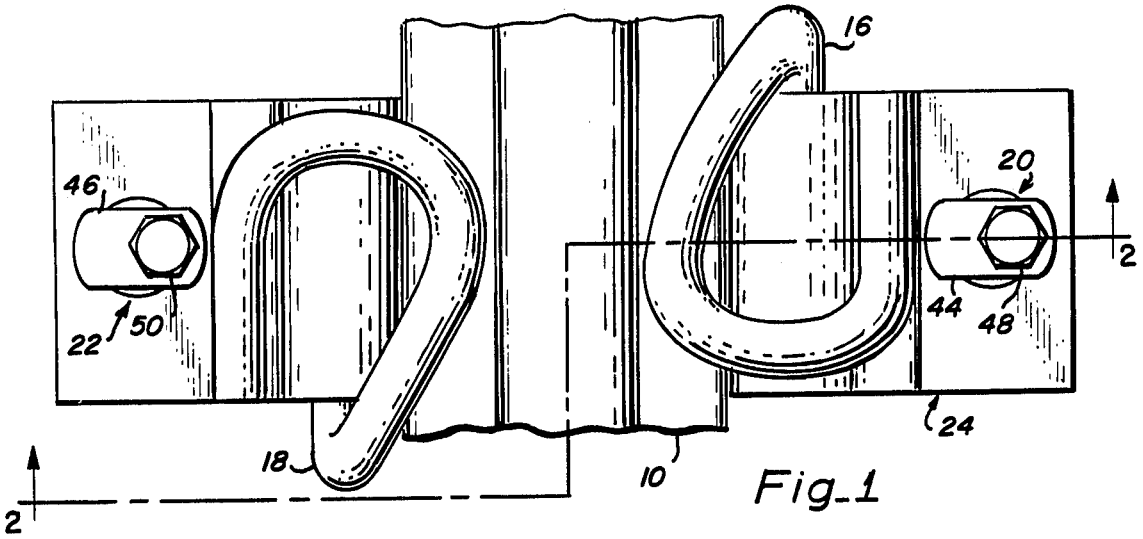
FIG. 1 is a plan view of a rail fastener constructed in accordance with the principles of the present invention.
Figure 2:
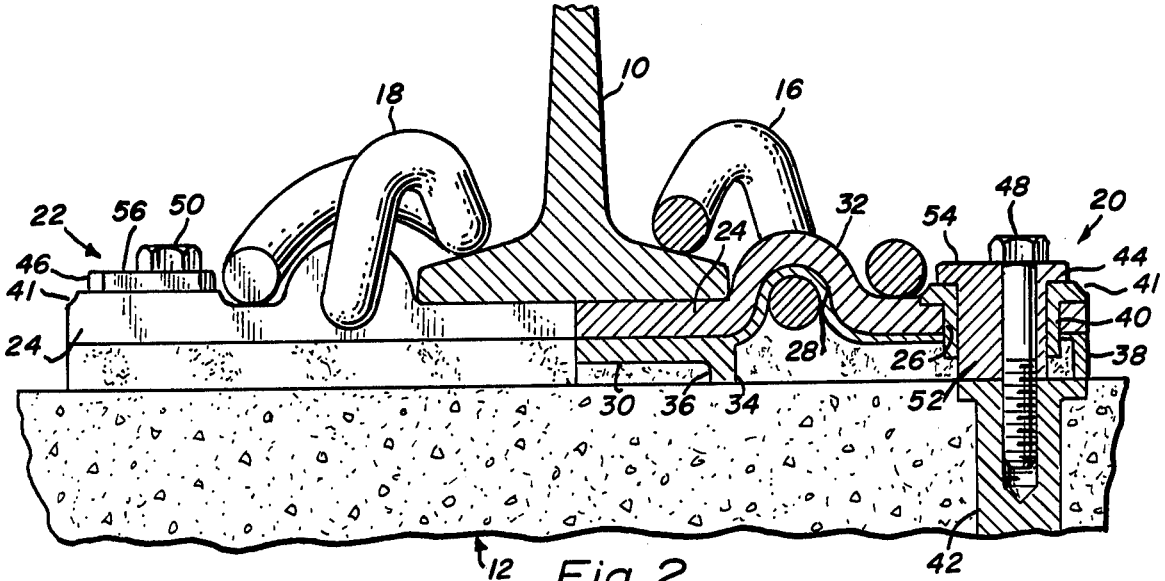
FIG. 2 is a partial sectional view taken generally along line 2—2 of FIG. 1.
Figure 3:
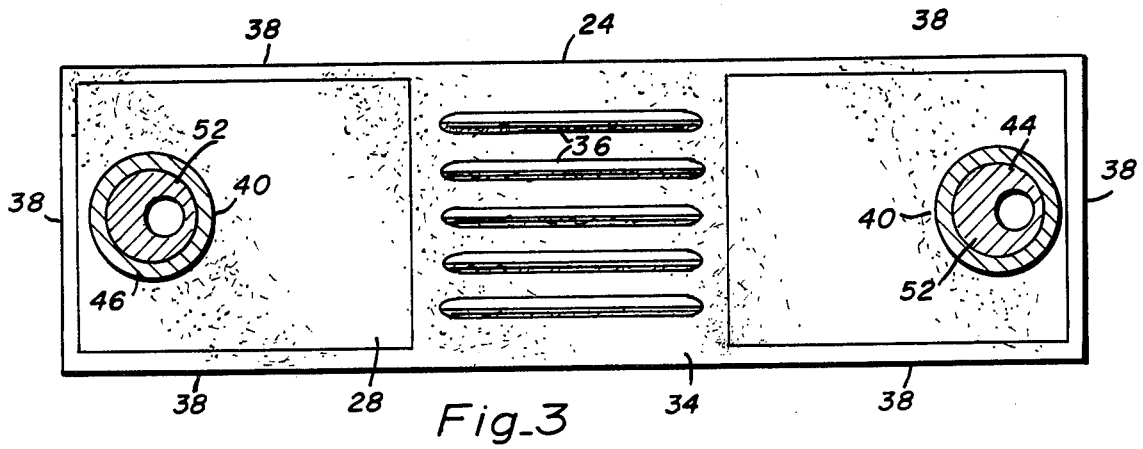
FIG. 3 is a bottom view of the rail fastener base illustrated in FIGS. 1 and 2.

With reference to FIGS. 1 and 2, there is shown a rail fastener which is constructed in accordance with the principles of the present invention for holding a rail 10 onto a support structure 12, such as a concrete slab. The fastener generally includes a base 14, a pair of Pandrol clips 16 and 18, and a pair of lateral restraining and adjusting elements, generally designated with the reference numerals 20 and 22.

Base 14 is formed of a rail plate 24 having a pair of openings 26 on opposite sides thereof for receiving the elements 20 and 22 therein, and an elastomeric material bonded to its lower surface which is preferably relatively soft and elastic polyurethane.

Rail plate 24 has a central portion 30 which is dimensioned for accommodating the rail 10 thereon, formed by a pair of U-shaped sections 32, one of which is shown in FIG. 2. These U-shaped sections provide the shoulders of a well for rail 10 to restrain the same laterally. U-shaped sections 32 are also dimensioned for receiving one end of Pandrol clips 16 and 18, respectively, therein, and the other end of each of the Pandrol clips 16 and 18 is disposed for bearing against a portion of the upper surface of rail plate 24. The center section of each of the Pandrol clips 16 and 18 is disposed for bearing against the respective one of the upper surfaces of the foot of rail 10. The Pandrol clips 16 and 18 are dimensioned such that when they are inserted into the U-shaped sections 32 and bear against the foot of the rail 10, they are in a flexed state, or in a state of compression. Accordingly, it can be appreciated that Pandrol clips 16 and 18 elastically clamp rail 10 onto plate 24. Furthermore, any transient loads which tend to lift rail 10 off base 14 will be absorbed by flexure of Pandrol clips 16 and 18.

Elastomeric material 28 at the lower surface of rail plate 24 includes a relatively thick pad portion coextensive with central section 30 of rail plate 24 and a skirt portion 38 which is coextensive with the periphery of rail plate 24 which seals the bottom of the rail plate from the elements. Pad 34 is provided with a plurality of voids 36 which afford a savings in the material.

There is also provided an insulator bushing 40 which may be made of a hard polyurethane so that it is substantially non-compressible. Bushing 40 has a collar 41 and the length of bushing body is such that, when inserted into opening 26, it extends slightly below the flash of material 28 which coats the lower surface of plate 24 between pad 34 and skirt 38.

Each of the lateral restraining and adjusting elements 20 and 22 includes an insert 42 which is embedded in the concrete support structure 12, with an upper surface thereof being flush with the upper surface of the support structure 12. The elements 20 and 22 also include eccentric members 44 and 46, respectively, each having an aperture therethrough for receiving bolts 48 and 50, respectively, which are in threaded engagement with inserts 42. Eccentrics 44 and 46 each include a cylindrical portion 52 which is received by the openings in insulator bushing 40. Eccentrics 44 and 46 also include cylindrical flanges 54, and 56, respectively, which are integral with respective cylindrical portions 52 and are each provided with a pair of flats thereon, such that they can be rotated by a wrench, for example. The shoulders provided between the cylindrical flange portions 54 and 56 and the cylindrical portions 52 bear against collar 41 of bushings 40. The length of cylndrical portions 52 is substantially equal to the distance between the upper surface of collar 41 of bushings 40 when seated in bore 26 of rail plate 24 when pad 34 and skirt 38 are in uncompressed or substantially uncompressed state. Accordingly, when the bolts 48 and 50 are completely tightened, plate 24 is restrained from being lifted above its no-load position while it is free to go lower against the compression of the elastic pad.

When bolts 48 and 50 are loosened, eccentrics 44 and 46 can be rotated around an axis of the apertures therethrough which receive bolts 48 and 50. Rotation of eccentrics 44 and 46 move plate 24 and rail 10 in a lateral direction with respect to support structure 12. After eccentrics 44 and 46 have been rotated to position plate 24 with respect to the support structure 12, bolts 48 and 50 are tightened, such that eccentrics 44 and 46 will be held in their respective positions. This positioning of plate 24 with respect to support structure 12 is customarily performed before the Pandrol clips 16 and 18 are mounted on the base 14. While rail 10 is on base 14, but before Pandrol clips 16 and 18 are mounted thereon, it will move with plate 24 during rotation of the eccentrics 44 and 46 because of the engagement of the U-shaped sections 32 with the lower flanges thereof. After plate 24 has been properly positioned in a lateral direction with respect to support structure 12, bolts 48 and 50 are tightened and Pandrol clips 16 and 18 are mounted on plate 24 to engage the lower flanges of rail 10.

Pandrol clips 16 and 18 are mounted on plate 24 by driving respective ends thereof into the voids defined by U-shaped portions 32 with a sledge hammer, for exemple. Once Pandrol clips 16 and 18 have been mounted on rail plate 24 and are in engagement with the lower flanges of rail 10 in a compressed state, any subsequent longitudinal movement of rail 10 with respect to plate 24 is restrained by the frictional engagement of the Pandrol clips 16 and 18 with the foot of rail 10 and the frictional engagement between the bottom surface of the rail 10 and plate 24. If plate 24 cannot move longitudinally with respect to rail 10, eccentrics 44 and 46 cannot be rotated a significant amount. Accordingly, if bolts 48 and 50 should loosen after installation, the longitudinal restraint provided by Pandrol clips 16 and 18 will tend to hold eccentrics 44 and 46 in their approximately positions, thereby maintaining the lateral position of plate 24 with respect to support structure 12. That is, Pandrol clips 16 and 18 serve the dual function of not only holding rail 10 onto plate 24, but restraining longitudinal movement of rail 10 with respect to plate 24, thereby locking eccentrics 44 and 46 in their desired positions.

Inserts 42 and eccentrics 44 and 46 effectively from posts for laterally restraining plate 24. It can be appreciated that if it is unnecessary for elements 20 and 22 to provide lateral adjustability, these posts can be formed as one piece. The posts formed by inserts 42 and eccentrics 44 and 46 have a cross sectional area which is sufficient to eliminate the possibility of any movement thereof whenever any expected lateral shear forces are imposed thereon. That is, any lateral shear force which can be expected under maximum loading conditions will not bend or move eccentrics 44 and 46 after they have been locked in position by bolts 48 and 50, respectively.

It should also be noted that by limiting the width of pad 34 to underline only the portion of the rail plate 24 underlying rial 10, the tendency of plate 24 to bend under imposed vertical loads is mostly diminished. That is, since pad 34 of elastomeric material is confined only to the area directly below rail 10, the remaining portions of rail plate 24 are relatively free to move in a vertical direction because they do not have a overcome elastic pad forces. Skirt 38 is relatively free to compress and therefore does not mutually restrain the ends of the rail plate to move in a downward direction. Even though the width of pad 34 is shown to be the same as the well receiving the foot of the rail, it should be understood that the width may be smaller or greater to provide the desired restraint, but the width is selected to prevent rail plate bending. Also, the Pandrol clips 16 and 18 absorb the majority of the upward forces imposed by base 14 and restraining elements 20 and 22.

It will be noted that the rail fastener of the present invention does not have any voids therein for the accumulation of any debris between the support structure and the rail plate which may produce an electrically conductive path between rail 10 and support structure 12. The voids which exist on the underside of the base 14 are enclosed and protected by skirt 38. Furthermore, the absence of such voids increases the structural integrity of the fastener of the present invention. That is, there are no openings in the plate 24 which are unsupported, thereby providing a high degree of structural integrity to the rail plate 24. Any lateral shear forces which are imposed on the lateral restraining elements 20 and 22 will be completely absorbed and transmitted to the inserts 42 without fatiguing any of the parts of the fastener.

What is claimed is:

1. A fastener for supporting a rail on a support structure comprising:

a rail plate including, an upper surface for nonresiliently supporting the rail, a pair of spaced apart openings and a well dimensioned to accommodate the rail and secure the rail against lateral movement, the sides of said well being formed by bows of generally U-shaped configuration in said rail plate;

clip means anchored in the channel formed in the underside of said rail plate by said bow and clampingly engaging said rail plate, said clip means being shaped and located to allow said rail to rise above said rail plate under the application of an upwardly directed force applied to said rail;

a pad of elastomer mounted between said rail plate and the support structure;

electrical insulator bushing means of a substantially non-resilient material dimensioned to be received by said openings and having collars for engaging the upper surface of said rail plate; and a pair of post means connected to the support structure, each post means including an eccentric received by and in vertically slidable engagement with one of said bushings for laterally restraining said rail plate with respect to said support structure and for providing electrical isolation therebetween, each of said eccentrics having collar means in non-clamping vertical engagement with the collar of said bushing which engages said rail plate for allowing said rail plate to freely float upon said pad of elastomer in the substantially uncompressed state when said rail plate is unloaded and defines a no-load level, and for precluding said rail plate for rising above said no-load level while permitting said rail plate to move downwardly under the application of a downwardly directed force applied to said rail, each of said post means further including an insert embedded into the support structure and an anchor bolt for clamping said eccentric firmly against said insert thereby releasably restraining vertical and rotational movement of said eccentric.

2. A fastener in accordance with claim 1 in which said pad of elastomer extends only over the portion of said rail plate which underlies the foot of the rail.

3. A fastener in accordance with claim 1 in which said pad of elastomer extends only over a portion of said rail plate which is symmetric with the portion underlying the foot of the rail and does not extend to said spaced apart openings.

4. A fastener in accordance with claim 3 which includes a skirt of elastomer between said rail plate and the support structure which extends substantially along the periphery of said rail plate.

* * * * *